US007312779B1

(12) United States Patent
Blevins

(10) Patent No.: US 7,312,779 B1
(45) Date of Patent: Dec. 25, 2007

(54) METHOD OF COLOR CALIBRATION FOR TRANSMISSIVE DISPLAYS

(75) Inventor: David Winn Blevins, Earlysville, VA (US)

(73) Assignee: Northrop Grumman Corporation, Los Angeles, CA (US)

( * ) Notice: Subject to any disclaimer, the term of this patent is extended or adjusted under 35 U.S.C. 154(b) by 561 days.

(21) Appl. No.: 10/670,084

(22) Filed: Sep. 23, 2003

(51) Int. Cl.
*G09G 3/36* (2006.01)

(52) U.S. Cl. ..... 345/102

(58) Field of Classification Search ..... 345/102, 345/690, 55, 87, 88, 204; 324/770
See application file for complete search history.

(56) References Cited

U.S. PATENT DOCUMENTS

| | | | | |
|---|---|---|---|---|
| 6,677,958 | B2 * | 1/2004 | Cottone et al. | 345/589 |
| 7,002,546 | B1 * | 2/2006 | Stuppi et al. | 345/102 |
| 7,034,852 | B2 * | 4/2006 | Matsuda et al. | 345/690 |
| 2001/0008395 | A1 * | 7/2001 | Yamamoto et al. | 345/102 |
| 2002/0060759 | A1 * | 5/2002 | Kim | 349/70 |
| 2002/0118182 | A1 * | 8/2002 | Luther Weindorf | 345/204 |
| 2003/0210221 | A1 * | 11/2003 | Aleksic | 345/102 |

OTHER PUBLICATIONS

CIE Technical Report CIE 122—1996 pp. 6-15 CIE Central Bureau, Vienna, Austria.

Mark D. Fairchild and David R. Wyble "Colorimetric Characterization of the Apple Studio Display" Munsell Color Science Laboratory Technical Report; Rochester Institute of Technology; Rochester, NY 14623-5604.

* cited by examiner

*Primary Examiner*—Amr A. Awad
*Assistant Examiner*—Stephen G Sherman
(74) *Attorney, Agent, or Firm*—Seymour Levine; Michael H. Wallach

(57) ABSTRACT

A transmissive display system is calibrated by applying DAC values for a target color and noting the color displayed on the screen. The displayed color is compared to the target color in high and low ambient light levels to determine if it is within a specified tolerance of the target color. Should the displayed color not be within the tolerance range, a calibration procedure is launched for both the high and low light levels which establishes new DAC values and backlight levels for accurate target color presentation on the screen over a wide dynamic range of input signal levels.

10 Claims, 6 Drawing Sheets

METHOD OF COLOR CALIBRATION FOR TRANSMISSIVE DISPLAYS

BACKGROUND OF THE INVENTION

1. Field of the Invention

The invention pertains to the field of transmissive displays and more particularly to a method of determining input values for providing the primary color luminances required for a set of specified colors to be displayed thereon.

2. Description of the Prior Art

Transmissive display systems have been developed to provide flat-panel monitors for numerous applications, including aircraft instrumentation, personal computers, laptop and notebook computers, and the like. Such displays potentially offer greater luminance, higher contrast ratios, greater sharpness, and better spatial uniformity than CRT displays. These systems utilize a light source, termed a backlight, to illuminate the pixels on the flat panel. Light intensity from the backlight is normally maintained at constant level and color is provided by the relative luminosity of the light transmitted through three primary color filters, usually selected as red, green, and blue, associated with each pixel on the screen. The intensity of the light from each filter is controlled by analog signals which in turn are selected by digital signals representative of the desired pixel color. These analog signals are selected from a look-up table which is accessed by the color representative digital signals.

Due to the backlight leakage through the primary color filters, the black level in a transmissive display is not as dark as the black level in a CRT. Consequently, transmissive displays have lower contrast ratios than CRTs. Further, when the luminance of a primary color is reduced by decreasing the video level, the measured color coordinates shift. This is largely the result of mixing the intended level of the primary colors with a backlight leakage component, which is also represented in the black level.

Colors produced on the screen of an uncompensated transmissive display may vary from the desired luminance and chromaticity of the target colors. Such variances may be caused by factors such as primary filter color variations, external flare, nonlinearities, and backlight leakage. Since measured color coordinates of the primary colors are not constant with input signal levels, due to backlight leakage, proper addition of the primary colors may not always be achieved. This problem is most severe when very low signal levels are required for use in low light ambient conditions. Consequently, when applied to transmissive displays, the prior art calibration methods can fail to achieve specified accuracy of chromaticity and luminance. To provide required chromaticity and luminance, a transmissive display system must be calibrated by modifying the process used to generate the input signals and calculating compensated input values which may be stored in a look-up table.

In the prior art, monitors were color calibrated and adjustments were made, if needed, either manually or automatically. The manual system, which is time consuming, requires a color calibration for each of a multiplicity of specified colors followed by a manual adjustment of the analog signals to bring each of the specified colors within predetermined tolerances. The closed loop system, which is expensive to set-up and maintain, monitors a specified color while the control signals are varied until the color being calibrated is within the predetermined tolerance. This procedure is repeated for each of the specified colors. Besides their difficulty and expense, these processes can fail when the chromaticity of primary colors varies with input signal level.

SUMMARY OF THE INVENTION

In accordance with the present invention, evaluation parameters for the chromaticity and luminance on the screen of a transmissive display system established with DAC values for a target color are determined. Should the evaluation parameters for a target not be within a specified acceptance criteria, a calibration procedure is initiated wherein the measured characteristics of tristimulus values and luminance are used to develop modified DAC values until the evaluation parameters for the target color are within the specified acceptance criteria. When the evaluation parameters are within the specified criteria, the DAC look-up table index values for the modified parameters are noted and applied to display target color.

Accurate colors with high contrast in low light level environments are achieved on the screen by adjusting the luminance of the backlight downward to accommodate the full span of DAC values. A backlight level control value is established by the ratio of the adjusted luminance to the full luminance for day time conditions. The initial DAC look-up table remains the same, but may be modified in accordance with other characteristics for operation in a low light level environment.

The DAC look-up table and the backlight control are constructed and arranged for two operating conditions, which may be termed; day time and night time. A switch, activated by an ambient light condition sensor, is provided for the selection of the appropriate settings.

DESCRIPTION OF THE PREFERRED EMBODIMENTS

Figure 1:
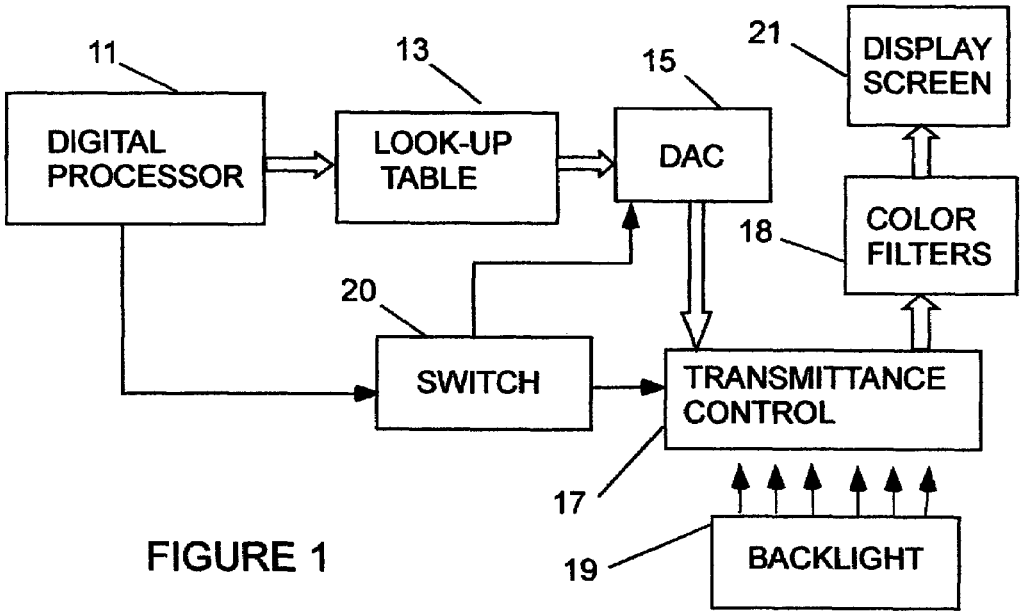
FIG. 1 is a block diagram of a flat panel transmissive display system.

As shown in FIG. 1, a flat panel transmissive display system may include a digital processor 11 wherein the ambient light conditions and desired colors to appear on the screen of the system are determined. For each such color a DAC look-up table 13 is used to determine the DAC values required to produce the desired color. Digital signals (DAC values) representative of the luminance of the respective primary colors are coupled from the look-up table 13 to a digital-to-analog converter (DAC) 15 wherein the respective digital signals are converted to corresponding analog signals. The use of a DAC look-up table is not limiting. The digital signals may be coupled to any converter device appropriate to the display interface employed, ie digital serial, parallel, MUX, etc. These signals, which respectively represent the relative luminance of the primary colors, are respectively coupled to a light transmittance control 17 positioned at each pixel that provides the light intensities of the primary colors that produce the desired pixel color. Each pixel contains a filter 18 for each of the primary colors which are respectively illuminated by the primary color light intensities provided by the transmittance control 17. A backlight 19 provides a constant illumination level that is modified by the transmittance of each of the illuminated primary filters to provide the luminances required to establish the desired color on the display screen 21. The DAC look-up table is utilized for both high light level ambience, such as a daytime light background, and low light level ambience, such as exists at night. Further, at night, the luminance of the backlight may differ from that at daytime light levels. Consequently, a switch 20, which may include a light level sensor for automatic operation or to provide an indication of optimum switch position, is coupled to the DAC look-up table 15 and the backlight 19 that is operable to switch the settings of these elements between high and low level light ambience values.

Figure 2:
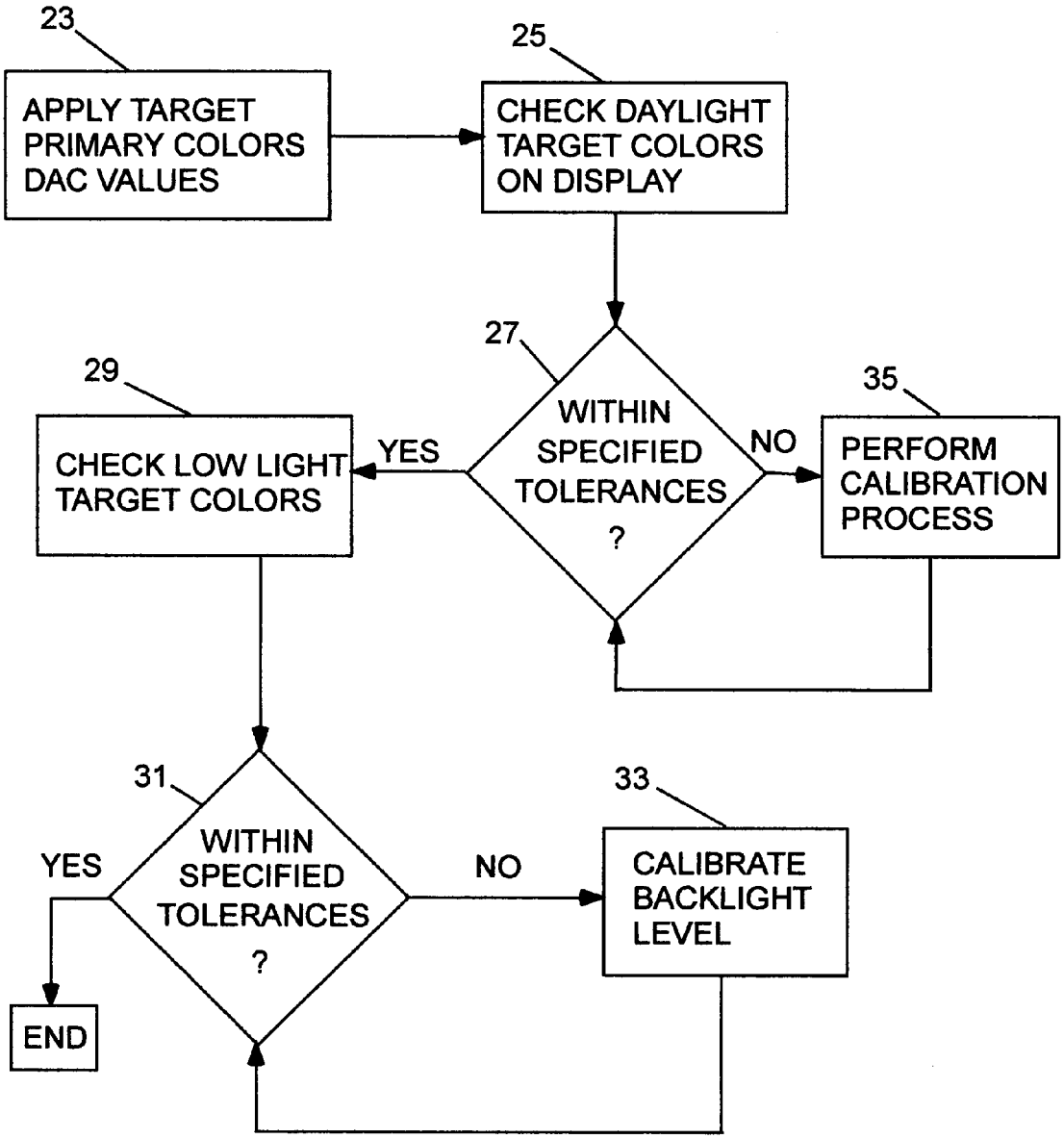
FIG. 2 is a flow chart of the calibration procedure of the invention indicating the process employed for achieving desired chromaticities.

Refer now to FIG. 2, which is a flow chart of a transmissive display color calibration procedure. In a daylight environment, the primary colors DAC values for a target display color are applied 23 to the DAC and the resulting chromaticity and luminance on the display are checked 25 with an instrument such as a spectroradiometer and the resulting values are compared 27 to the desired chromaticity and luminance of the target color. If the comparison indicates that these are within specified tolerances, the calibration proceeds with a check of chromaticity and luminance at low light levels 29. The low light level values are compared 31 to the desired chromaticity and luminance. Should these values be within specified tolerances, the calibration procedure is complete. In the event that the values are not within the specified tolerances, the backlight is adjusted 33 and other modifications, yet to be described, are made, where—after the comparison 31 is repeated. Iterations of this procedure continue until the color on the screen is within the specified tolerances. In the event that the comparison of the measured and target day light chromaticity and luminance values are not within the specified tolerances, a calibration process 35 is initiated and iterated until the specified values are achieved.

Figure 3:
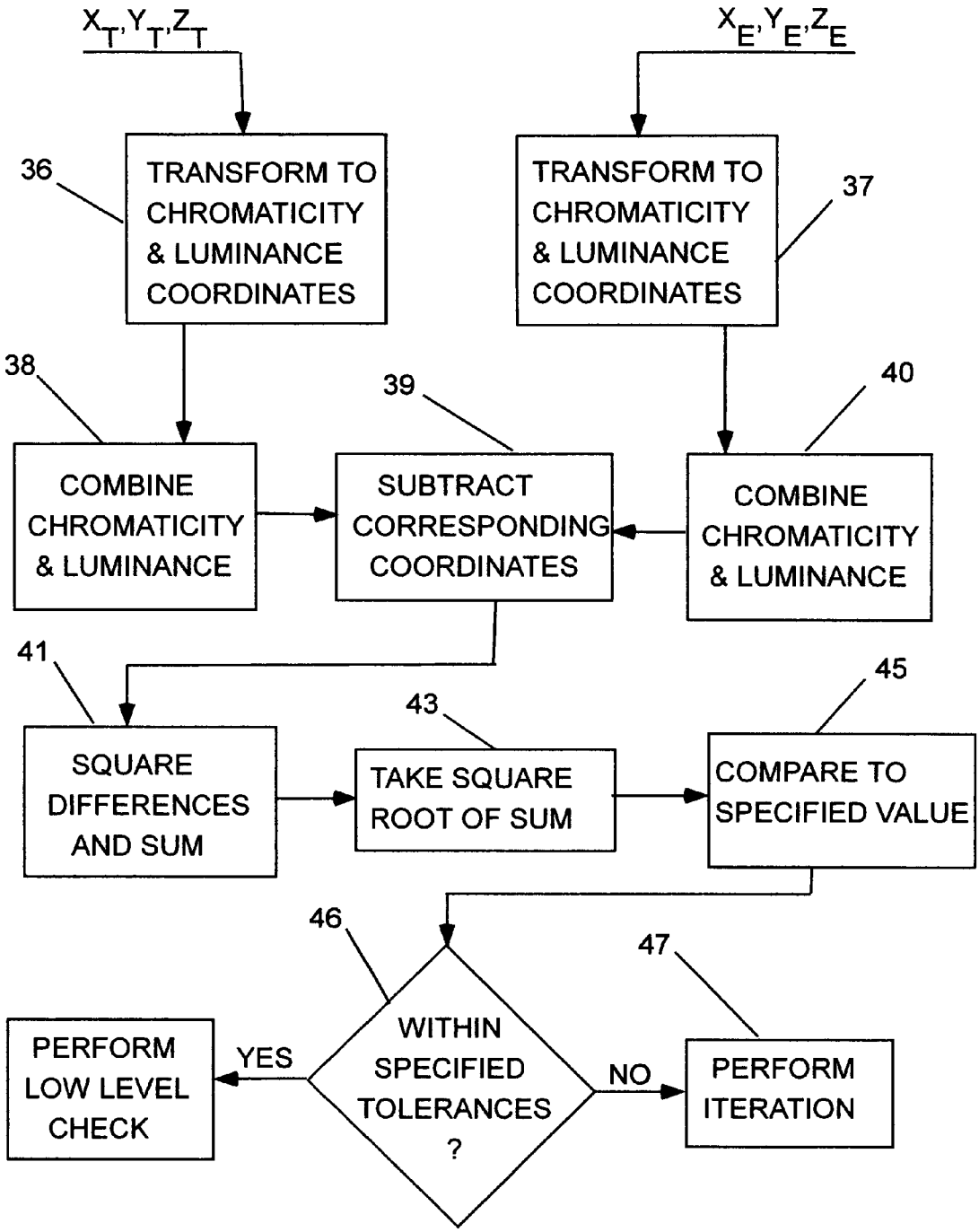
FIG. 3 is a flow chart of a method for determining the errors between chromaticity of a target color and its measured chromaticity.

The calibration process may be performed with the utilization of tristimulus values for a target color, which are known, and measured tristimulus values. FIG. 3 is a flow chart of a procedure which may be utilized for the calibration process 35. Tristimulus values $X_T$, $Y_T$, $Z_T$ of the target color and $X_E$, $Y_E$, $Z_E$ calculated from measured display characteristics are respectively transformed 36,37 to a u, v, chromaticity coordinate system wherein equal displacements correspond to equal color differences. Values u and v for each of the transformations may be determined from the tristimulus values as follows:

$$u' = \frac{4X}{X + 15Y + 3Z}$$

$$v' = \frac{Y}{X + 15Y + 3Z}$$

An accurate comparison between two colors, requires a combination of the chromaticity and luminance of each color. This combination 38,40 may be achieved by transforming coordinates u, v, and Y to new coordinates u*, v*, L* as follows:

$$u^* = 13\,L^*(u' - u_0)$$
$$v^* = 13\,L^*(v' - v_0)$$
$$L^* = 116\,(Y/Y_0) - 16\,Y/Y_0 \qquad Y/Y_0 \geqq 0.008856$$
$$L^* = 903.3\,(Y/Y_0) \qquad Y/Y_0 < 0.008856$$

The coordinates u*, v*, and L* may be utilized as evaluation parameters.

Values $u^*_E$, $v^*_E$, $L^*_E$, determined from estimated tristimulus values of the comparison color, are respectively subtracted 39 from $u^*_T$, $v^*_T$, and $L^*_T$, determined from tristimulus values of the target color, to obtain $(u^*_T - u^*_E)$, $(v^*_T - v^*_E)$ and $(L^*_T - L^*_E)$. These differences are squared and summed 41 and the square root of the sums is taken 43 to obtain:

$$\Delta E^* = [(L^*_T - L^*_E)^2 + (u^*_T - u^*_E)^2 + (v^*_T - v^*_E)^2]^{1/2}$$

$$\Delta C^* = [(u^*_T - u^*_E)^2 + (v^*_T - v^*_E)^2]^{1/2}$$

Figure 5:
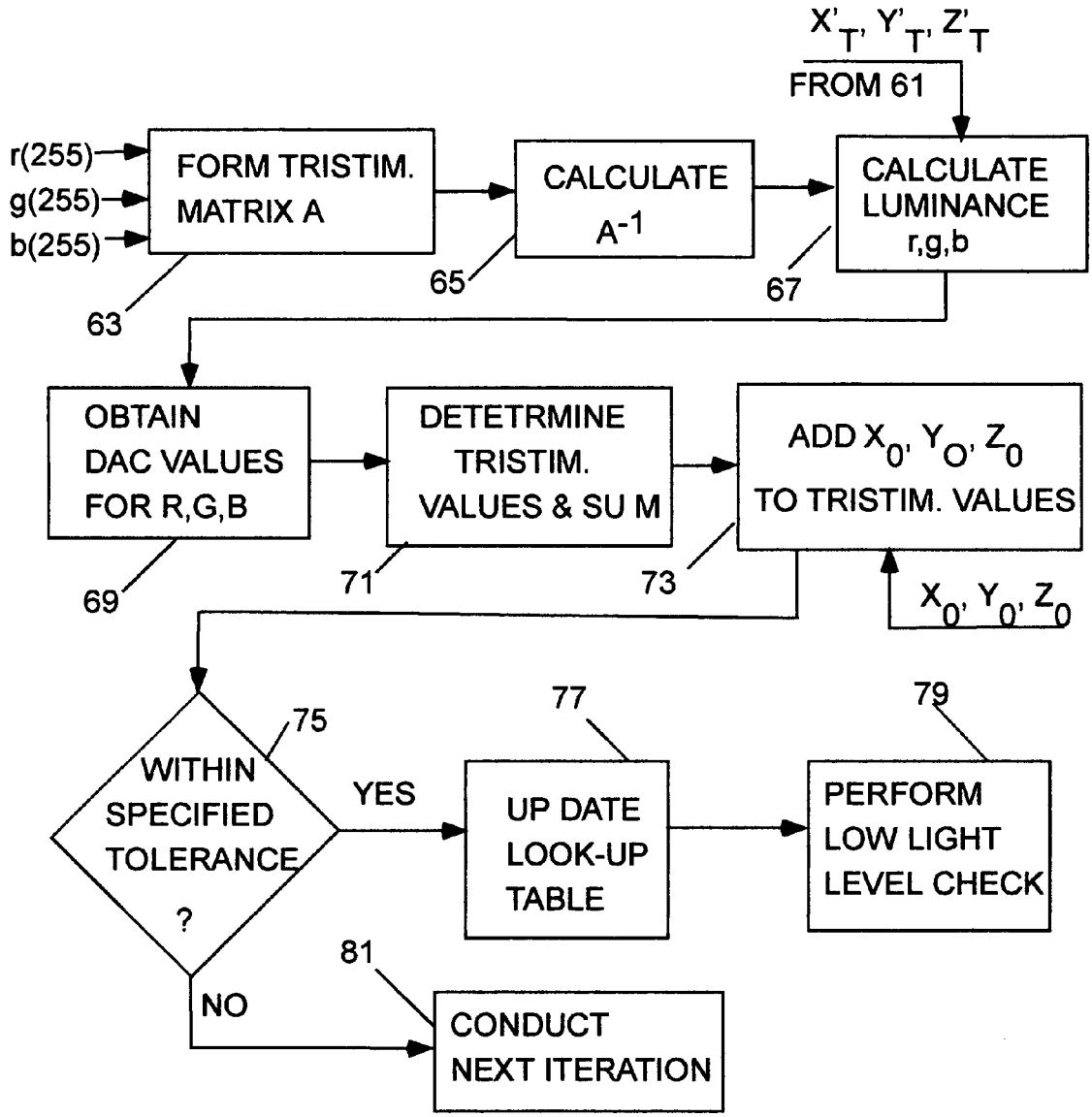
FIG. 5 is a flow chart of a procedure for determining compensated DAC values utilizing the parameters obtained with the procedure of FIG. 4.
Figure 6:
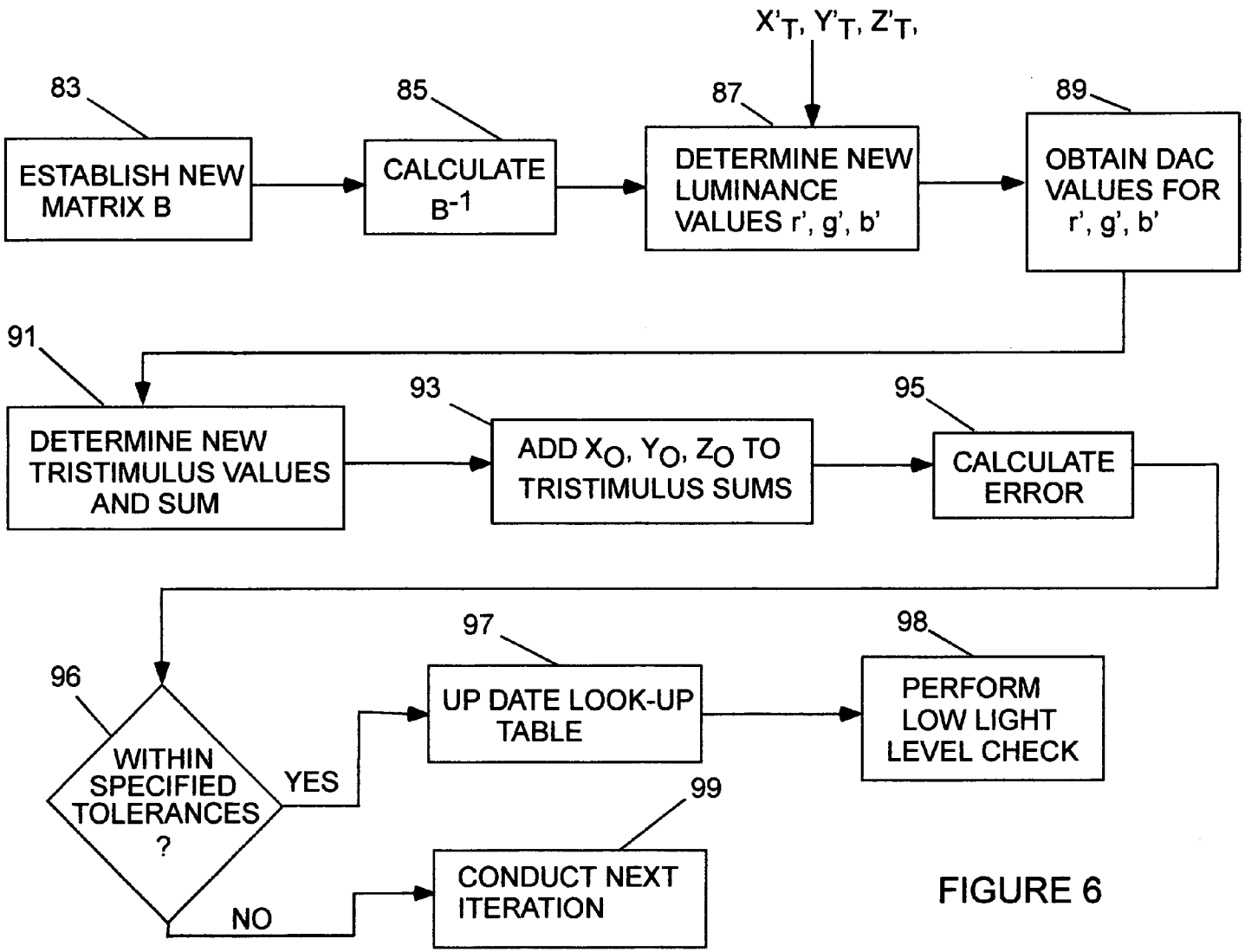
FIG. 6 is a flow chart for an iteration step correcting for shift in color coordinates of primary colors modifying the results of the procedure of FIG. 5.

ΔE* and ΔC* are respectively compared 45 to selected tolerance values and a decision 46 is made as to whether ΔE* and ΔC* are within the specified tolerances. If the tolerance requirements are not met, the calibration continues with an iteration 47 as shown in FIGS. 4, 5, and 6.

Figure 4:
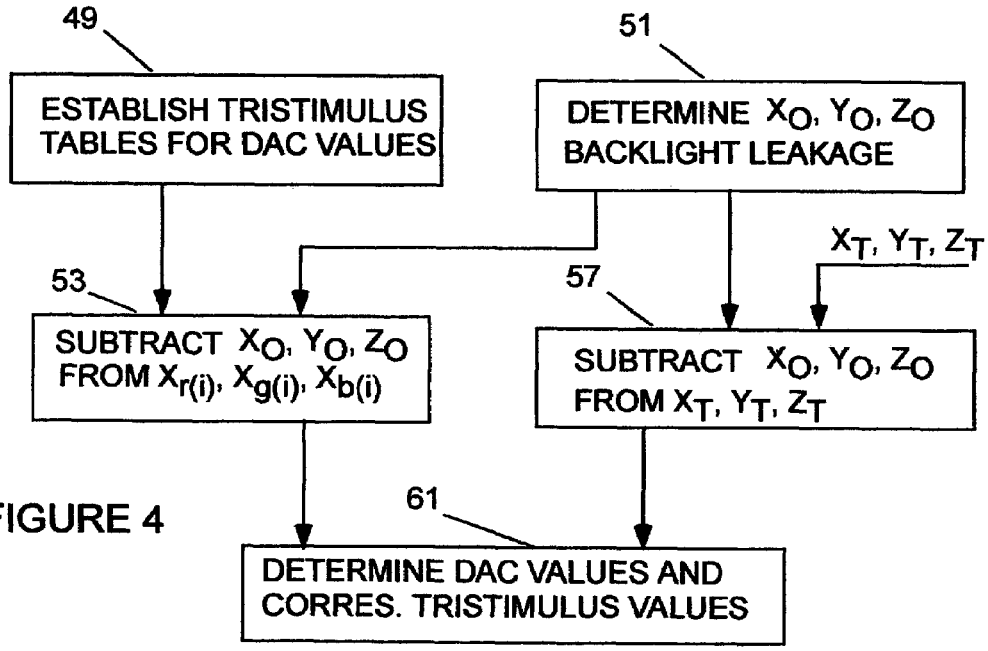
FIG. 4 is a flow chart of a procedure for obtaining parameters used in determining compensated tristimulus values for comparison to target tristimulus values.

Referring to FIG. 4, a table 49 is established of the tristimulus values for the primary colors, which may be, red, green, and blue. Values for the table are determined by activating one filter, for example the red filter, for all the DAC values successively and respectively measuring the resulting tristimulus values while the other filters are deactivated (DAC value set to zero). This is repeated for all three primary colors until the table, represented as TABLE 1, is completed. It should be recognized that each of the primary colors on the screen may contain traces of the other two primary colors. Consequently, each primary color has a stimulus value not only for that primary color, but for the other two as well.

TABLE 1

| | Red | | | Green | | | Blue | | |
|---|---|---|---|---|---|---|---|---|---|
| DAC | $X_r$ | $Y_r$ | $Z_r$ | $X_g$ | $Y_g$ | $Z_g$ | $X_b$ | $Y_b$ | $Z_b$ |
| 0 | $X_{0r}$ | $Y_{0r}$ | $Z_{0r}$ | $X_{0g}$ | $Y_{0g}$ | $Z_{0g}$ | $X_{0b}$ | $Y_{0b}$ | $Z_{0b}$ |
| 1 | $X_{1r}$ | $Y_{1r}$ | $Z_{1r}$ | $X_{1g}$ | $Y_{1g}$ | $Z_{1g}$ | $X_{1b}$ | $Y_{1b}$ | $Z_{1b}$ |
| • | • | • | • | • | • | • | • | • | • |
| • | • | • | • | • | • | • | • | • | • |
| • | • | • | • | • | • | • | • | • | • |
| • | • | • | • | • | • | • | • | • | • |
| 254 | $X_{254r}$ | $Y_{254r}$ | $Z_{254r}$ | $X_{254g}$ | $Y_{254g}$ | $Z_{254g}$ | $X_{254b}$ | $Y_{254b}$ | $Z_{254b}$ |
| 255 | $X_{255r}$ | $Y_{255r}$ | $Z_{255r}$ | $X_{254g}$ | $Y_{255g}$ | $Z_{255g}$ | $X_{255b}$ | $Y_{255b}$ | $Z_{255b}$ |

Values in the table include the backlight leakage through the filters. To eliminate the effect of the backlight leakage, the DAC values for each of the filters is set to zero, while the backlight remains on, and tristimulus values $X_0$, $Y_0$, $Z_0$ are determined 51, and subtracted 53 from each of the corresponding values in Table 1. The backlight leakage values $X_0$, $Y_0$, $Z_0$ are also subtracted 57 from $X_T$, $Y_T$, $Z_T$ of the target color to respectively obtain modified tristimulus values $X'_T$, $Y'_T$, $Z'_T$. The backlight corrected table, shown as Table 2, is a DAC tristimulus look-up table from which tristimulus values for a given digital signal input may be determined. The modified target color tristimulus values obtained from Table 2 are then utilized to determine DAC values and corresponding estimated tristimulus values 61 for the displayed color.

TABLE 2

| | Red | | | Green | | | Blue | | |
|---|---|---|---|---|---|---|---|---|---|
| DAC | $X''_r$ $X_r$-$X_0$ | $Y''_r$ $Y_r$-$Y_0$ | $Z''_r$ $Z_r$-$Z_0$ | $X''_g$ $X_g$-$X_0$ | $Y''_g$ $Y_g$-$Y_0$ | $Z''_g$ $Z_g$-$Z_0$ | $X''_b$ $X_b$-$X_0$ | $Y''_b$ $Y_b$-$Y_0$ | $Z''_b$ $Z_b$-$Z_0$ |
| 0 | $X''_{0r}$ | $Y''_{0r}$ | $Z''_{0r}$ | $X''_{0g}$ | $Y''_{0g}$ | $Z''_{0g}$ | $X''_{0b}$ | $Y''_{0b}$ | $Z''_{0b}$ |
| • | • | • | • | • | • | • | • | • | • |
| • | • | • | • | • | • | • | • | • | • |
| • | • | • | • | • | • | • | • | • | • |
| • | • | • | • | • | • | • | • | • | • |
| • | • | • | • | • | • | • | • | • | • |
| • | • | • | • | • | • | • | • | • | • |
| 255 | $X''_{255r}$ | $Y''_{255r}$ | $Z''_{255r}$ | $X''_{255g}$ | $Y''_{255g}$ | $Z''_{255g}$ | $X''_{255b}$ | $Y''_{255b}$ | $Z''_{255b}$ |

Refer now to FIG. 5, wherein a process for determining the estimated tristimulus and corresponding DAC values 61 is shown. A matrix of the tristimulus values of the red, green, and blue primary colors at DAC value 255 is formed 63 as follows:

$$A = \begin{bmatrix} X'_{255r} & X'_{255g} & X'_{255b} \\ Y'_{255r} & Y'_{255g} & Y'_{255b} \\ Z'_{255r} & Z'_{255g} & Z'_{255b} \end{bmatrix}$$

A stimulus value of a color is determined by the sum of the three products of the luminance of a primary color times the maximum stimulus value for that primary color. If r, g, and b represent luminance values of the primary colors creating a color, the tristimulus values for that color may be represented as:

$$X'=rX'_{255r}+gX'_{255g}+bX'_{255b}$$

$$Y'=rY'_{255r}+gY'_{255g}+bY'_{255b}$$

$$Z'=rZ'_{255r}+gZ'_{255g}+bZ'_{255b}$$

These equations may be represented by the following matrix equation.

$$\begin{bmatrix} X' \\ Y' \\ Z' \end{bmatrix} = \begin{bmatrix} X'_{255r} & X'_{255g} & X'_{255b} \\ Y'_{255r} & Y'_{255g} & Y'_{255b} \\ Z'_{255r} & Z'_{255g} & Z'_{255b} \end{bmatrix} \begin{bmatrix} r \\ g \\ b \end{bmatrix}$$

Thus the matrix A is a transformation matrix which transforms the luminance values r, g, b of a color to the tristimulus values for that color.

Luminance values $r_T$, $g_T$, and $b_T$ for the target color are obtained from the known tristimulus values $X'_T$, $Y'_T$, $Z_T'$ of that color by multiplying the tristimulus vector by the calculated inverse of matrix A 65 as follows:

$$\begin{bmatrix} r_T \\ g_T \\ b_T \end{bmatrix} = A^{-t} \begin{bmatrix} X'_T \\ Y'_T \\ Z'_T \end{bmatrix}$$

These $r_T$, $g_T$, $b_T$ luminance values are used to obtain corresponding DAC values 69 from Table 2. The DAC values are then used to obtain the tristimulus values for the primary color entries. Since colors are the result of the addition of the primary color vectors, the tristimulus vector corresponding to $r_T$, $g_T$, $b_T$ is the sum of the three vectors in tristimulus coordinates indexed by the DAC values respectively corresponding to $r_T$, $g_T$, $b_T$ Therefore the tristimulus vectors obtained by indexing Table 2 with the color coordinates of the target color are added 71 to obtain the tristimulus vector, the coordinates of which are estimated tristimulus values for the displayed color. In matrix form the resulting tristimulus values are:

$$\begin{bmatrix} X'_E \\ Y'_E \\ Z'_E \end{bmatrix} = \begin{bmatrix} X_R(j) + X_G(k) + X_B(l) \\ Y_R(j) + Y_G(k) + Y_B(l) \\ Z_R(j) + Z_G(k) + Z_B(l) \end{bmatrix}$$

where the j, k, and l are the DAC index values corresponding to the luminance values $r_T$, $g_T$, $b_T$.

$X'_E$, $Y'_E$, $Z'_E$, are tristimulus values obtained from a DAC table representative of the transmissive display system under test when accessed by the luminance values $r_T$, $g_T$, $b_T$ of the target color. These estimated tristimulus values, however, do not include the backlight contribution to the displayed color. To obtain the new tristimulus values $X_E$ $Y_E$, $Z_E$, the measured backlight values must be added 73 to the tristimulus values $X'_E$, $Y'_E$, $Z'_E$. Thus $$\begin{bmatrix} X_E \\ Y_E \\ Z_E \end{bmatrix} = \begin{bmatrix} X'_E + X_0 \\ Y'_E + Y_0 \\ Z'_E + Z_0 \end{bmatrix}$$

Tristimulus values $X_E$, $Y_E$, $Z_E$ are utilized in the calibration process previously described. If the acceptance criteria is met, the calibration is complete and the DAC index values j, k, l are utilized to up-date 77 the DAC look-up table and the low light level check 79 is then performed. Should the acceptance criteria not be met, the calibration continues with the next iteration as shown in FIG. 6.

A new matrix B' and its inverse $(B')^{-1}$ are then established 83, 85 utilizing the tristimulus values $X'_E$, $Y'_E$, $Z'_E$ which are respectively equal to $X'_R(i)+X'_R(j)+X'_R(k)$, $Y'_r(i)+Y'_r(j)+Y'_r(k)$, $Z'_R(i)+Z'_R(j)+Z'_R(k)$. This new matrix is utilized to multiply the tristimulus vector of the target color to obtain new luminance values r, g' b' 87. As shown in the following matrix equation $$\begin{bmatrix} X' \\ Y' \\ Z' \end{bmatrix} = \begin{bmatrix} X'_R(j_1) + X'_G(j_1) + X'_B(k_1) \\ Y'_R(j_1) + Y'_G(j_1) + Y'_B(k_1) \\ Z'_R(j_1) + Z'_G(j_1) + Z'_B(k_1) \end{bmatrix} \begin{bmatrix} r' \\ g' \\ b' \end{bmatrix}$$

$$\begin{bmatrix} r' \\ g' \\ b' \end{bmatrix} = B^{-1} \begin{bmatrix} X' \\ Y' \\ Z' \end{bmatrix}$$

The new luminance values r', g', b' are utilized to obtain new DAC values 89 from which new tristimulus values $X''_E$, $Y''_E$, $Z''_E$ are determined 91, as previously described. Backlight tristimulus values $X_0$, $Y_0$, $Z_0$ are then respectively added 93 to $X''_E$, $Y''_E$, $Z''_E$ to obtain new estimated values $X_{EN}$, $Y_{EN}$, $Z_{EN}$ and an error calculation is made 95. Resulting errors are then compared to the established tolerance range and a decision 96 is made as to whether it is within the specified tolerance range. If the specified tolerance is met, the DAC index values $j_1$, $k_1$, $l_1$ are utilized to up-date the DAC look-up table 97 for the target color and the backlight level check is then performed 98. If the error is not within tolerance limits, another iteration is performed 99 in like manner.

Figure 7:
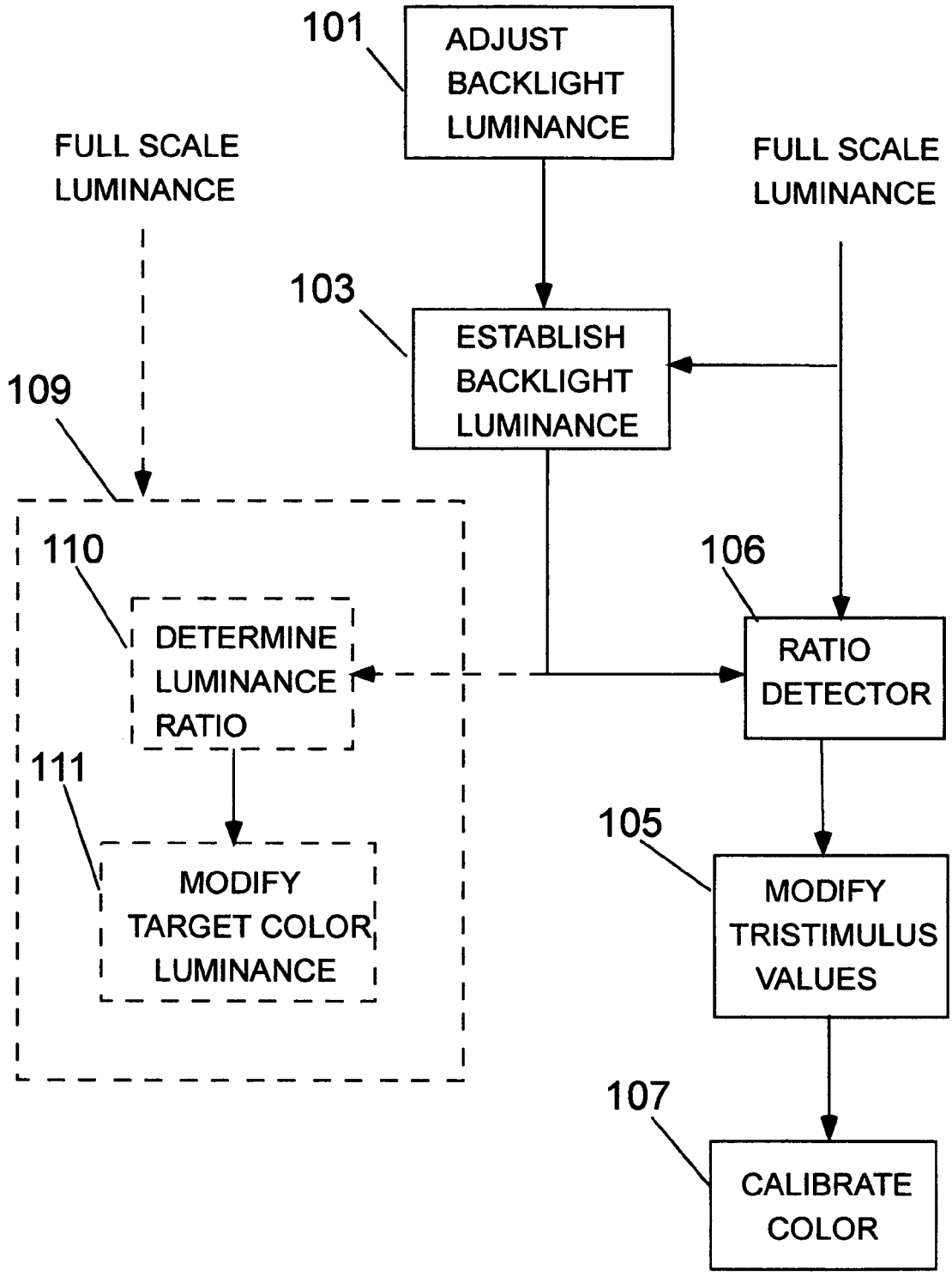
FIG. 7 is a flow chart for calibrating a transmissive display system for operation in a low light level ambience.

Accurate colors with high contrast in a transmissive display may be achieved when operating in an environment having an extremely low light level, such as a low light level ambience and light levels that exist at dusk and night. Refer now to FIG. 7. These accurate colors may be realized by adjusting the luminance of the backlight 101 of the transmissive display to a level that permits the full span of DAC values. The maximum backlight luminance level for low light level conditions may be determined by lowering the backlight level from full scale brightness defined for displays under daytime conditions until the desired luminance is achieved. Upon achieving the desired luminance, the backlight luminance level is noted and established 103 for operation under low light level conditions. The tables of tristimulus values are modified 105 by altering the luminance component by a ratio determined by a ratio detector 106 which establishes a ratio of the initial backlight luminance and desired backlight luminace. After the luminance modification of the tristimulus tables, the color calibration 107 described above is performed.

Alternatively, a processor 109 may be maybe provided that includes a ratio determinator 110 coupled to receive the initial (full scale) luminance and the desired backlight luminance which in turn couples a signal representative of the ratio to a target color luminance modifier 111 which modifies the target luminance in accordance with this ratio and the luminance of the subsequent tristimulus value.

While only certain embodiments of the invention have been described, it will be apparent to those skilled in the art that various changes and modifications may be made within the purview of the appended claims without departing from the true scope and spirit of the invention in its broader aspects.

I claim:

1. A method for color calibrating a transmissive display system comprising the steps of:

applying signal values that select a target color in a look-up table in said display system to establish color on a screen of said display system;

noting chromaticity of color displayed on said screen;

determining an evaluation parameter for said color utilizing said chromaticity;

determining a target evaluation parameter utilizing chromaticity of said target color;

comparing said color evaluation parameter to said target color evaluation parameter to establish a parameter difference value:

comparing said parameter difference value to said specified tolerance range; and creating a tristimulus table having tristimulus values for said primary colors for each signal value over an entire signal value range;

determining backlight tristimulus values;

subtracting backlight tristimulus values from corresponding tristimulus values in said tristimulus table to provide a corrected table;

subtracting said backlight tristimulus values from corresponding target color tristimulus values to provide corrected target color tristimulus values; utilizing said corrected table and said corrected target color tristimulus values to obtain estimated primary color luminance values corresponding to said target color, thereby providing modified signals;

establishing an evaluation parameter for color displayed in response to said modified signal values; and comparing said evaluation parameter for said response color to said target color evaluation parameter to determine if said response color is within said specified tolerance range of said target color, thereby providing a parameter difference within said tolerance range.

2. The method of claim 1 wherein said utilizing step includes the steps of:

forming a matrix of primary color tristimulus values obtained by accessing said corrected table at maximum signal values;

calculating an inverse matrix of said matrix;

multiplying a vector formed by said corrected target color tristimulus values by said inverse matrix to obtain a vector of primary color luminance values, each component of said vector representative of a primary color luminance value;

entering said corrected table with each component of said vector to obtain a new signal value for each primary color luminance value;

utilizing each new signal value to extract tristimulus values for a corresponding primary color from said corrected table, thereby providing extracted primary color tristimulus values;

adding corresponding tristimulus values of said extracted primary color tristimulus values and said backlight tristimulus values to obtain estimated tristimulus values;

adding said backlight tristimulus values to corresponding corrected target color tristimulus values to obtain target color tristimulus values;

using said estimated tristimulus values to establish an estimated evaluation parameter;

comparing said estimated evaluation parameter to said target evaluation parameter; and performing an iteration, utilizing a matrix formed with said estimated tristimulus values and said primary color luminace values, if said estimated evaluation parameter is not within said tolerance.

3. The method of claim 2 wherein said iteration performing step includes the steps of:

creating a new matrix utilizing said extracted primary color tristimulus values;

calculating an inverse matrix of said new matrix, thereby providing a new inverse matrix;

multiplying said vector formed by said corrected target color tristimulus values by said new inverse matrix to obtain a new vector of primary color luminance values, each component of said new vector representative of a primary color;

entering said corrected table with each component of said new vector to obtain a further new signal value for each primary color;

utilizing each further new signal value to extract new tristimulus values for a corresponding primary color from said corrected table, thereby providing new extracted primary color tristimulus values;

adding corresponding tristimulus values of said new extracted primary color tristimulus values and said backlight tristimulus values to obtain new estimated tristimulus values;

using said new estimated tristimulus values to establish an estimated evaluation parameter;

comparing said estimated evaluation parameter to said target evaluation parameter; and performing another iteration, utilizing a matrix formed with said estimated tristimulus values and said primary color luminance values, if said estimated evaluation parameter is not within said tolerance.

4. The method of claim 3 wherein said another iteration performing step includes the steps of:

creating a new matrix utilizing said extracted primary color tristimulus values;

calculating an inverse matrix of said new matrix, thereby providing a new inverse matrix;

multiplying said vector formed by said corrected target color tristimulus values by said new inverse matrix to obtain a new vector of primary color luminance values, each component of said new vector representative of a primary color;

entering said corrected table with each component of said new vector to obtain a further new signal value for each primary color;

utilizing each further new signal value to extract new tristimulus values for a corresponding primary color from said corrected table, thereby providing new extracted primary color tristimulus values;

adding corresponding tristimulus values of said new extracted primary color tristimulus values and said backlight tristimulus values to obtain new estimated tristimulus values;

using said new estimated tristimulus values to establish an estimated evaluation parameter;

comparing said estimated evaluation parameter to said target evaluation parameter; and modifying said display system to access said new signal value to display said target color if said estimated parameter is within said tolerance range.

5. The method of claim 4 further including the steps of:

applying signal values for a color within said specified tolerance range in a first ambient light condition;

lowering said backlight luminance, in a second ambient light condition, from a first backlight luminance until a desired contrast level is achieved, thereby determining a second backlight luminance; and establishing said second backlight luminance for operation in said second ambient light condition.

6. The method of claim 1 wherein said utilizing step includes the steps of forming a matrix of primary color tristimulus values obtained by accessing said corrected table at maximum signal values;

calculating an inverse matrix of said matrix;

multiplying a vector formed by said corrected target color tristimulus values by said inverse matrix to obtain a vector of primary color luminance values, each component of said vector representative of a primary color luminance value;

entering said corrected table with a component of said vector to obtain a new signal value for each primary color luminance value, utilizing each new signal value to extract tristimulus values for a corresponding primary color from said corrected table;

adding corresponding tristimulus values of said primary color tristimulus values and said backlight tristimulus values to obtain estimated tristimulus values, adding said backlight tristimulus values to corresponding corrected target color tristimulus values to obtain target color tristimulus values;

using said estimated tristimulus values to establish an estimated evaluation parameter;

comparing said estimated evaluation parameter to said target evaluation parameter; and modifying said display system to access said new DAC value to display said target color if said estimated parameter is within said tolerance range.

7. The method of claim 6 further including the steps of:

applying signal values for a color within said specified tolerance range;

lowering backlight level from full brightness until a desired contrast level is achieved, thereby determining a second ambient light level backlight luminance; and establishing said second ambient light level backlight luminance for operation in said second ambient light level.

8. The method of claim 6 further including the steps of:

applying signal values for a color within said specified tolerance range in said first ambient light;

lowering backlight luminance from a first luminance level until a second luminance level at which a desired color luminance is achieved in said second ambient light, thereby determining a second ambient light backlight luminance; and establishing said second ambient light backlight luminance for operation in said second ambient light.

9. The method of claim 1 further comprising the steps of:

checking color displayed on said screen in a second ambient light condition, to determine a second ambient light color;

comparing said second ambient light color to said target color to determine if said second ambient light color is within said specified tolerance range;

adjusting backlight level when said second ambient light color is not within said tolerance range to provide a color within said tolerance range.

10. The method claim 1 further including the steps of:

lowering backlight luminance from a first luminance level to a second luminance level at which a desired color luminance is achieved;

establishing a ration of said first and second luminance levels; and utilizing said ratio to modify said tristimulus table.

* * * * *